US009035164B2

(12) United States Patent
Ohnishi

(10) Patent No.: US 9,035,164 B2
(45) Date of Patent: May 19, 2015

(54) KEYBOARD MUSICAL INSTRUMENT

(71) Applicant: Yamaha Corporation, Hamamatsu-Shi, Shizuoka-Ken (JP)

(72) Inventor: Kenta Ohnishi, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/161,583

(22) Filed: Jan. 22, 2014

(65) Prior Publication Data

US 2014/0202321 A1 Jul. 24, 2014

(30) Foreign Application Priority Data

Jan. 22, 2013 (JP) ..... 2013-009269

(51) Int. Cl.

| | |
|---|---|
| ***G10H 1/32*** | (2006.01) |
| ***G10H 3/00*** | (2006.01) |
| ***G10C 3/06*** | (2006.01) |
| ***G10H 3/14*** | (2006.01) |

(52) U.S. Cl.

CPC .. *G10H 1/32* (2013.01); *G10C 3/06* (2013.01); *G10H 3/146* (2013.01); *G10H 2210/271* (2013.01); *G10H 2220/461* (2013.01); *G10H 2230/011* (2013.01)

(58) Field of Classification Search

USPC ..... 84/744

See application file for complete search history.

(56) References Cited

U.S. PATENT DOCUMENTS

| | | | | |
|---|---|---|---|---|
| 5,247,129 | A * | 9/1993 | Nozaki et al. | 84/615 |
| 5,262,586 | A | 11/1993 | Oba et al. | |
| 5,880,389 | A * | 3/1999 | Muramatsu | 84/615 |
| 5,886,279 | A * | 3/1999 | Inaba | 84/721 |
| 7,332,669 | B2 * | 2/2008 | Shadd | 84/742 |
| 8,067,685 | B2 * | 11/2011 | Parish | 84/726 |
| 8,502,062 | B2 * | 8/2013 | Mishima et al. | 84/743 |
| 2007/0017353 | A1 * | 1/2007 | Kunisada et al. | 84/723 |
| 2010/0147132 | A1 | 6/2010 | Shinjo et al. | |
| 2012/0247309 | A1 | 10/2012 | Matsuda | |
| 2013/0061734 | A1 * | 3/2013 | Koseki et al. | 84/189 |
| 2013/0118333 | A1 * | 5/2013 | Ohnishi et al. | 84/192 |

FOREIGN PATENT DOCUMENTS

| | | | |
|---|---|---|---|
| JP | 4500735 | A | 2/1992 |
| JP | H0460594 | A | 2/1992 |
| JP | H05-73039 | A | 3/1993 |
| JP | H05-204376 | A | 8/1993 |
| JP | 2007-096690 | A | 4/2007 |
| JP | 2008-225498 | A | 9/2008 |
| JP | 2008-281589 | A | 11/2008 |

(Continued)

OTHER PUBLICATIONS

European Search Report dated May 9, 2014, for EP Application No. 14151562.7, seven pages.

(Continued)

*Primary Examiner* — Jeffrey Donels

(74) *Attorney, Agent, or Firm* — Morrison & Foerster LLP

(57) ABSTRACT

A keyboard musical instrument, including: a key; a board; a first member formed of a material different from a material of the board; a first acoustic transducer configured to vibrate the board in accordance with a drive signal supplied thereto; and a second acoustic transducer configured to vibrate the first member in accordance with a drive signal supplied thereto.

8 Claims, 8 Drawing Sheets

(56) References Cited

FOREIGN PATENT DOCUMENTS

| | | | |
|---|---|---|---|
| JP | 2008-292739 | A | 12/2008 |
| JP | 4735662 | B2 | 7/2011 |
| WO | WO-9003025 | A1 | 3/1990 |

OTHER PUBLICATIONS

Notification of Reason for Refusal dated Jan. 30, 2015, for JP Application No. 2013-009269, with English translation, five pages.

* cited by examiner

KEYBOARD MUSICAL INSTRUMENT

CROSS REFERENCE TO RELATED APPLICATION

The present application claims priority from Japanese Patent Application No. 2013-009269, which was filed on Jan. 22, 2013, the disclosure of which is herein incorporated by reference in its entirety.

BACKGROUND OF THE INVENTION

1. Field of the Invention

The present invention relates to a keyboard musical instrument configured to generate, using an acoustic transducer, musical sounds different from musical sounds generated by striking a string.

2. Description of Related Art

As disclosed in the following Patent Literatures 1 and 2, for instance, a keyboard musical instrument is known in which an acoustic transducer is operated by a drive signal to thereby vibrate a soundboard, so that sounds are generated from the soundboard. The sound from the soundboard is effective to increase the thickness of musical sounds.

Patent Literature 1: JP-A-04-500735

Patent literature 2: Japanese Patent No. 4735662

SUMMARY OF THE INVENTION

However, in an instance where the sounds are generated simply by vibrating a wooden soundboard by means of the acoustic transducer without particularly involving sound generation by striking a string, it is difficult to reproduce a metallic sound feel in the treble (high) range peculiar to acoustic pianos. In addition, the soundboard is positioned considerably lower than the string, so that a sense of sound image may be lowered and a sense of realism may be impaired or deteriorated.

On the other hand, even in an instance where the sound is generated by vibration of the soundboard along with the sound generation by striking the string, the sound becomes massive owing to the vibration of the soundboard mainly in only the middle range and the bass (low) range, and the vibration of the soundboard does not make much contribution for the treble range.

As disclosed in the Patent Literature 2, there is known a technique of complementing or assisting sound generation in the treble range by providing a speaker apart from the sonudboard, so as to allow the sounds in the treble range to be emitted from the speaker. However, the speaker has strong directivity, giving an awkward or unnatural feeling as compared with acoustic piano sounds.

The present invention has been made to solve the conventionally experienced problems described above. It is a first object of the invention to provide a keyboard musical instrument capable of generating natural and rich sounds by layering sounds of different timbres.

It is a second object of the invention to provide a keyboard musical instrument capable of generating natural and rich sounds by vibrating or exciting sound generating member owing to vibration of a frame.

The first object indicated above may be attained according to a first aspect of the invention, which provides a keyboard musical instrument, comprising: a key (2); a board (7); a first member (70) formed of a material different from a material of the board; a first acoustic transducer (50) configured to vibrate the board in accordance with a drive signal supplied thereto; and a second acoustic transducer (80) configured to vibrate the first member in accordance with a drive signal supplied thereto.

In the keyboard musical instrument described above, it is possible to generate natural and rich sounds by layering sounds of different timbres.

The second object indicated above may be attained according to a second aspect of the invention, which provides a keyboard musical instrument, comprising: a key (2); a sound generator (5) provided so as to correspond to the key; a hammer (4) configured to strike the sound generator in response to an operation of the key; a frame (70) that supports the sound generator; an acoustic transducer (80) configured to vibrate the frame in accordance with a drive signal supplied thereto; and a signal generator (15) configured to generate the drive signal based on performance information in accordance with the operation of the key and configured to supply the generated drive signal to the acoustic transducer.

In the keyboard musical instrument described above, the sound generator is vibrated by vibration of the frame, so that natural and rich sounds can be generated.

Forms of the Invention

There will be described various forms of the invention.

A keyboard musical instrument, comprising: a key (2); a board (7); a first member (70) formed of a material different from a material of the board; a first acoustic transducer (50) configured to vibrate the board in accordance with a drive signal supplied thereto; and a second acoustic transducer (80) configured to vibrate the first member in accordance with a drive signal supplied thereto.

In the keyboard musical instrument described above, it is possible to generate natural and rich sounds by layering sounds of different timbres.

The keyboard musical instrument may further comprise: a sound generator (5) provided so as to correspond to the key; and a hammer (4) configured to strike the sound generator in response to an operation of the key, wherein the first member is a frame (70) that supports the sound generator.

In the keyboard musical instrument, the board may be a soundboard (7) configured to be vibrated by vibration of the sound generator (5).

In the keyboard musical instrument, the board (7) may be formed of wood, and the first member (70) is formed of metal.

According to the keyboard musical instrument described above, existing components in the keyboard musical instrument can be utilized.

The keyboard musical instrument may further comprise a signal generator (15) configured to generate the drive signal based on at least one of performance information generated in accordance with an operation of the key, performance information read out from a storage unit (12), and performance information sent from an external device, and configured to supply the generated drive signal to at least one of the first acoustic transducer (50) and the second acoustic transducer (80).

In the keyboard musical instrument, the signal generator (15) may be configured to supply the generated drive signal simultaneously to the first acoustic transducer (50) and the second acoustic transducer (80) when supplying the generated drive signal to both of the first acoustic transducer and the second acoustic transducer.

The keyboard musical instrument may further comprise: a sound generator (5) provided so as to correspond to the key (2); and a hammer (4) configured to strike the sound generator in response to an operation of the key; and a detector (22)

configured to detect the operation of the key. The signal generator (15) may be configured to supply the drive signal to the second acoustic transducer (80) based on the operation of the key detected by the detector, such that the first member (70) is vibrated in synchronization with timing when the hammer strikes the sound generator.

The keyboard musical instrument may further comprise a speaker configured to omit sound based on a sound signal supplied thereto. The signal generator (15) may be configured to supply the drive signal to the second acoustic transducer (80) such that the first member (70) is vibrated in synchronization with timing when the speaker emits the sound.

In the keyboard musical instrument, the signal generator (15) may be configured to generate the drive signals to be supplied to the first acoustic transducer (50) and the second acoustic transducer (80), respectively, such that a frequency band of the drive signal to be supplied to the second acoustic transducer is larger then a frequency band of the drive signal to be supplied to the first acoustic transducer.

A keyboard musical instrument, comprising: a key (2); a sound generator (5) provided so as to correspond to the key; a hammer (4) configured to strike the sound generator in response to an operation of the key; a frame (70) that supports the sound generator; an acoustic transducer (80) configured to vibrate the frame in accordance with a drive signal supplied thereto; and a signal generator (15) configured to generate the drive signal based on performance information in accordance with the operation of the key and configured to supply the generated drive signal to the acoustic transducer.

In the keyboard musical instrument described above, the sound generator is vibrated by vibration of the frame, so that natural and rich sounds can be generated.

In the keyboard musical instrument, the sound generator may be a string (5), the keyboard musical instrument may further comprise a soundboard (7) configured to be vibrated by vibration of the string, and the frame (70) may be formed of metal.

In the keyboard musical instrument described above, it is possible to effectively emphasize the treble range in sound generation by vibration of the soundboard.

The reference numerals in the brackets attached to respective constituent elements in the above description correspond to reference numerals used in the following embodiments to identity the respective constituent elements. The reference numerals attached to each constituent element indicates a correspondence between each element and its one example, and each element is not limited to the one example.

BRIEF DESCRIPTION OF DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

There will be hereinafter explained embodiments of the present invention with reference to the drawings.

<First Embodiment>

Figure 1:
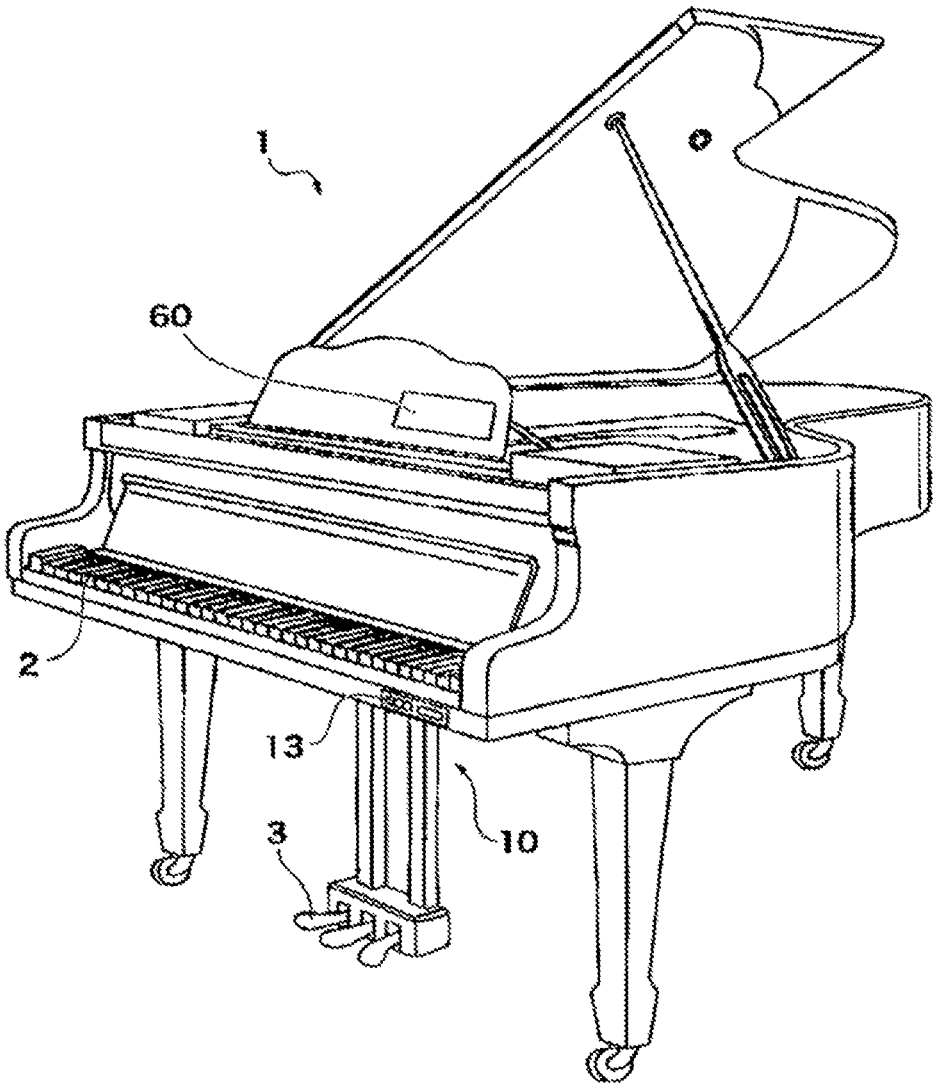
FIG. 1 is a perspective view showing an external appearance of a keyboard musical instrument according to a first embodiment of the invention.

FIG. 1 is a perspective view showing an external appearance of a keyboard musical instrument according to a first embodiment of the invention. In the first embodiment, a grand piano 1 is illustrated as one example of the keyboard musical instrument.

The grand piano 1 has, on its front side, a keyboard in which are arranged a plurality of keys 2 to be operated for performance by a performer (user) and pedals 3. The grand piano 1 further has a controller 10 having an operation panel 13 on its front surface portion and a touch panel 60 provided at a portion of a music stand. User's instructions can be input to the controller 10 by a user's operation on the operation panel 13 and the touch panel 60.

The grand piano 1 is configured to generate sounds in one of a plurality of sound generation modes that is selected in accordance with a user's instruction. The sound generation modes include a normal sound generation mode, a weak sound mode, and a strong sound mode. In the normal or intermediate sound generation mode, sounds are generated only by striking a string by a hammer as in ordinary grand pianos. In the weak sound mode, the string striking by the hammer is prevented, and a soundboard is vibrated by an acoustic transducer using a signal sent from a sound source such as an electronic sound source, so that sounds are generated from the soundboard with a natural timbre in a volume smaller than usual (or alternatively in a volume larger than usual).

The strong sound mode is a mode for generating sounds by the string striking as in the normal sound generation mode and performing with sounds larger than sounds when generated by the string striking by the hammer (the normal sound generation mode), by vibrating the soundboard by means of the acoustic transducer using a signal of a piano tone color. In the strong sound mode, not only a sound volume is increased, but also a tone color layer effect is obtained by simultaneously executing the sound generation by the string striking by the hammer and the sound generation by vibrating the soundboard by means of the acoustic transducer using a signal of a tone color other than the piano tone color (including a tone color that resembles the piano tone color).

Further, the grand piano 1 is configured to be operated in one of a plurality of performance modes that is selected in accordance with a user's instruction. The performance modes include a normal performance mode in which sounds are generated by a user's performance operation of the grand piano 1 and an automatic performance mode in which keys are automatically driven to generate sounds.

Figure 2:
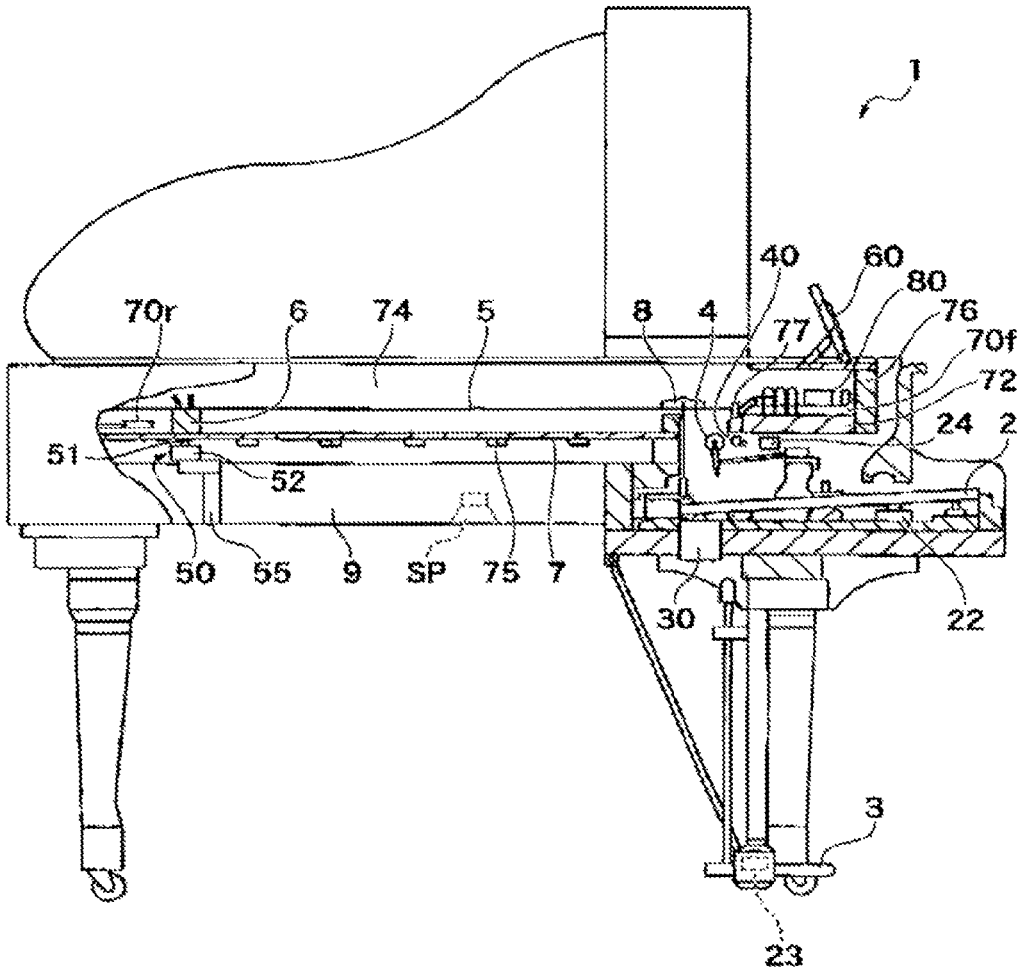
FIG. 2 is a cross-sectional view showing an internal structure of a grand piano.

FIG. 2 is a cross-sectional view showing an internal structure of the grand piano 1.

In FIG. 2, structures provided for each of the keys 2 are illustrated focusing on one key 2, and illustration of the structures for other keys 2 is omitted. It is noted that the following explanation will be made focusing on one key 2 where appropriate for the sake of brevity. A key drive unit 30 is provided below a rear end portion of each key 2 (i.e., on a rear side of each key 2 as viewed from the user who plays the piano 1 on the front side of the piano 1). The key drive unit 30 is for driving the corresponding key 2 using a solenoid.

The key drive unit 30 is configured to drive the solenoid in accordance with a control signal sent from the controller 10 based on automatic performance data when the automatic performance mode is selected as the performance mode. That is, the key drive unit 30 drives the solenoid such that a plunger moves upward to reproduce a state similar to that when the user has depressed the key and such that the plunger moves downward to reproduce a state similar to that when the user has released the key.

Strings 5 (each as one example of a sound generator) and hammers 4 are provided so as to correspond to the respective keys 2. When one key 2 is depressed, the corresponding hammer 4 pivots via an action mechanism (not shown) so as to strike the string(s) 5 that correspond to the key 2. A damper 8 is configured to move in accordance with a depression amount of the key 2 and a step-on amount of a damper pedal among the pedals 3, such that the damper 8 is placed in a non-contact state in which the damper 8 is not in contact with the string(s) 5 or in a contact state its which the damper 8 is in contact with the string(s) 5. In the following description, the "pedal 3" will refer to the damper pedal unless otherwise specified, and the string or strings corresponding to one key is collectively referred to as "string".

A stopper 40 is for preventing the hammer 4 from striking the string 5 when the weak sound mode is set. That is, when the weak sound mode is set as the sound generation mode, a hammer shank hits on the stopper 40 so as to prevent the hammer 4 from striking the string 5. On the other hand, when the normal sound generation mode is set as the sound generation mode, the stopper 40 moves to a position at which the hammer shank does not hit on the stopper 40.

Key sensors 22 (each as one example of a detector) are provided so as to correspond to the prospective keys 2. Each key sensor 22 is disposed below the corresponding key 2 to output, to the controller 10, a detection signal in accordance with a behavior of the corresponding key 2. Hammer sensors 24 are provided so as to correspond to the respective hammers 4. Each hammer sensor 24 outputs, to the controller 10, a detection signal in accordance with a behavior of the corresponding hammer 4. Pedal sensors 23 are provided so as to correspond to the respective pedals 3. Each pedal sensor 23 outputs, to the controller 10, a detection signal in accordance with a behavior of the corresponding pedal 3.

A soundboard 7 (as one example of a board) is formed of wood or a wooden material and is a plate-shaped member as a whole. Soundboard ribs 75 and bridges 6 (a treble bridge 6H and a bass bridge 6L) are attached to the soundboard 7. A part of the strings 5 engages each bridge 6. As later explained, the strings 5 are stretched between the bridges 6 and agraffes 77. In the arrangement, vibration of the soundboard 7 is transmitted to the strings 5 via the bridges 6 while vibration of the strings 5 is transmitted to the soundboard 7 via the bridge 6.

Figure 3:
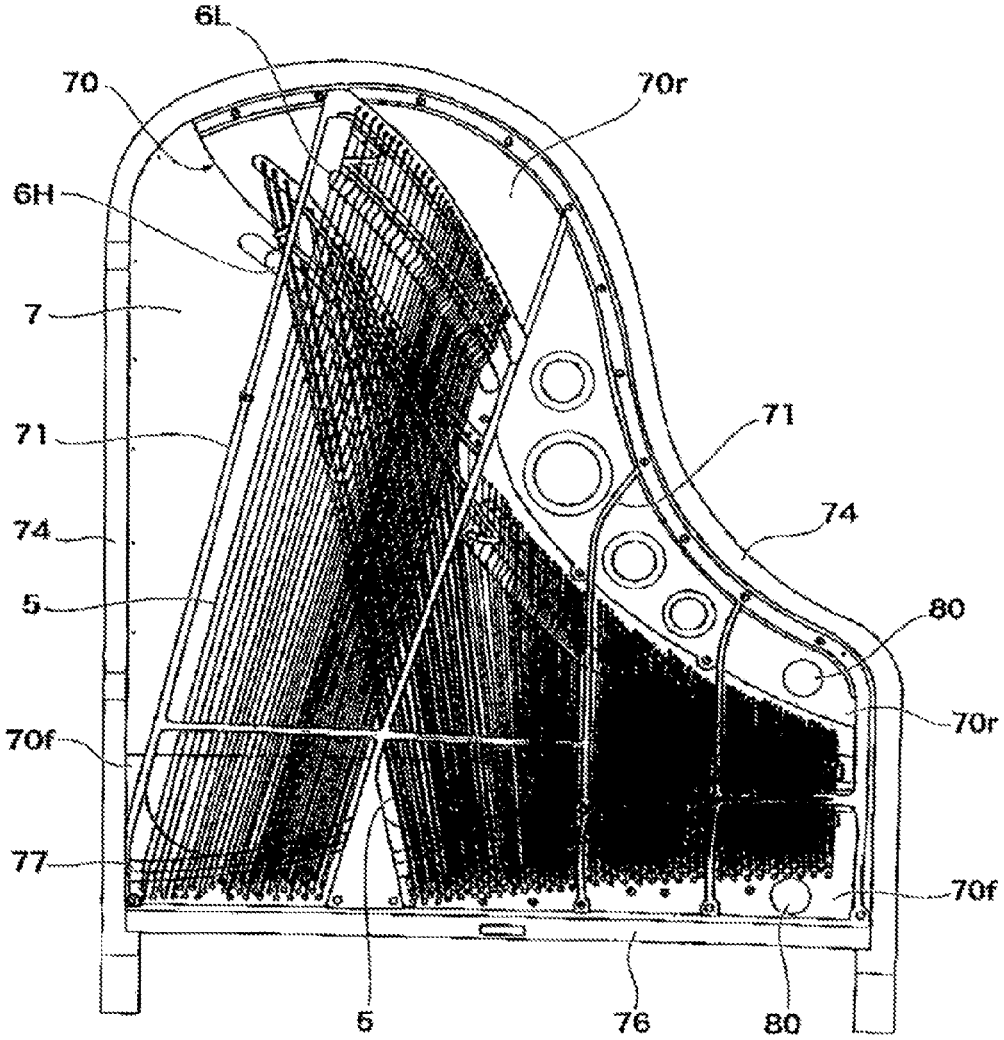
FIG. 3 is a plan view of the grand piano in which a lid is removed.
Figure 4:
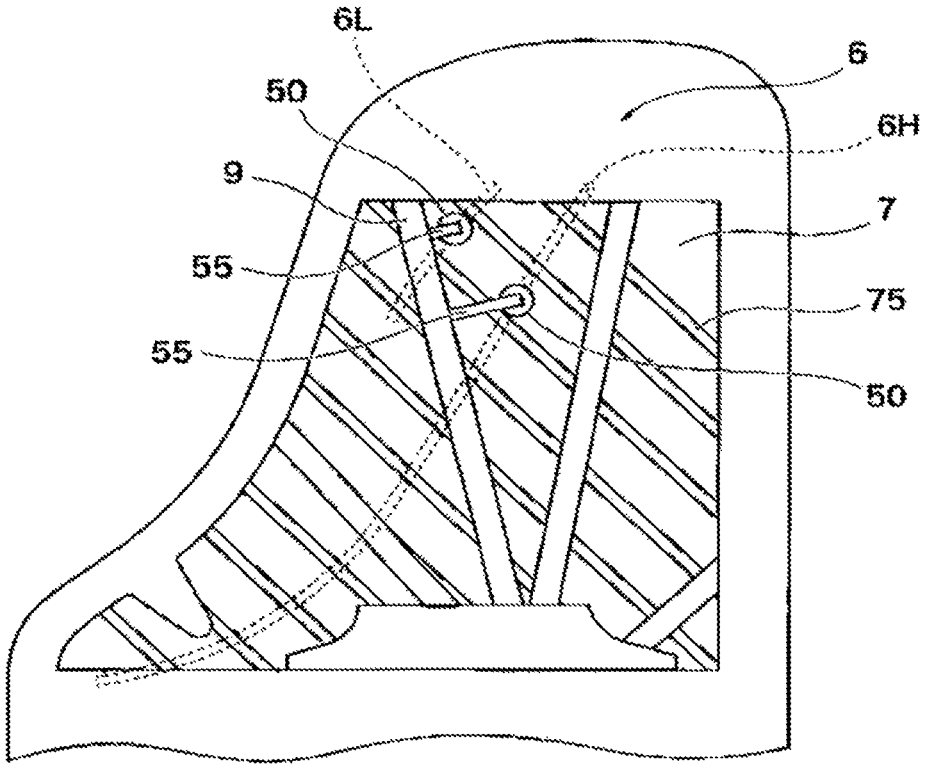
FIG. 4 is a view showing a back surface of a soundboard.

FIG. 3 is a plan view of the grand piano 1 in which a lid is removed. FIG. 4 is a view showing a back surface of the soundboard 7.

As shown in FIGS. 2 and 3, a frame 70 (as one example of a first member) is overlaid or superposed on the soundboard 7. The frame 70 is a flat member for supporting the strings 5 in a stretched state. The frame 70 has a known shape and is disposed in a known layout. The frame 70 has a front portion 70*f* and a rear portion 70*r* that are integrally formed of a metal such as iron. While the rear portion 70*r* is formed with a plurality of openings, each of the front portion 70*f* and the rear portion 70*r* has a generally flat plate portion. The front portion 70*f* and the rear portion 70*r* are connected to each other by a plurality of ribs 71 (FIG. 3). In a state in which the frame 70 is overlaid on the soundboard 7, the plate portion of each of the front portion 70*f* and the rear portion 70*r* is opposed to the soundboard 7.

The front portion 70*f* is fixed to: a support member 72 that is fixed to a front rail 76; and a side board 74 while the rear portion 70*r* is fixed to the side board 74, whereby the soundboard 7 and the frame 70 are fixed to an instrument main body (casing). As shown in FIG. 2, a speaker SP is disposed under the instrument main body.

The strings 5 engage, at rear end portions thereof, the rear portion 70*r* of the frame 70 via the bridges 6 and engage, at front end portions thereof, the front portion 70*f* of the frame 70 via the agraffes 77 provided on the front portion 70*f*. Thus, the strings 5 are stretched between the bridges 6 and the agraffes 77. The vibration of the strings 5 is transmitted to the frame 70, and the vibration of the frame 70 is transmitted to the strings 5. Accordingly, the vibration is transmitted not only between the soundboard 7 and the strings 5, but also between the frame 70 and the strings 5.

The soundboard 7 is formed of wood while the frame 70 is formed of a metal. Therefore, the soundboard 7 and the frame 70 have mutually different natural frequencies, and the range of sounds to be generated and the frequency at which vibration is efficiently transmitted differ between the soundboard 7 and the frame 70. The soundboard 7 generates sounds mainly in a range from the middle range to the bass (low) range when vibrated, but does not generate sounds in the treble (high) range so much. In contrast, the frame 70 can sufficiently generate sounds mainly in the treble range when vibrated.

In view of the above, in the present embodiment, acoustic transducers are connected to each of the soundboard 7 and the frame 70 to cause vibration. That is, acoustic transducers 50 (each as one example of a first acoustic transducer) are provided for the soundboard 7, and acoustic transducers 80 (each as one example of a second acoustic transducer) are provided for the frame 70, as explained below.

The acoustic transducer 50 will be explained. As shown in FIG. 4, two acoustic transducers 50 are installed on the back surface of the soundboard 7 between adjacent two of the plurality of soundboard ribs 75. In the present embodiment, a plurality of, namely, two acoustic transducers 50 that are identical in construction are connected to or provided so as to be held in close contact with the soundboard 7. The number of the acoustic transducers 50 provided on the soundboard 7 may be one. Each of the acoustic transducers 50 is disposed at a position as close as possible to the bridges 6H, 6L. In the present embodiment, each acoustic transducer 50 is disposed at a position of the back surface of the soundboard 7 at which the acoustic transducer 50 is opposed to the bridge 6 with the soundboard 7 interposed therebetween. Each acoustic transducer 50 is held in close contact with the soundboard 7 such that the acoustic transducer 50 is supported by a support portion 55 that is fixed to a back post 9. The back post 9 is a part of the casing that supports the weight of the grand piano 1.

Each acoustic transducer 50 is an actuator of a voice-coil type having a vibration portion 51 that is held in close contact with the soundboard 7 and a yoke holding portion 52 supported by the support portion 55. When a drive signal is input to a voice coil of the acoustic transducer 50 from the controller 10, the vibrating portion 51 vibrates, whereby the soundboard 7 is vibrated.

The acoustic transducers 80 will be explained. As shown in FIG. 3, one of two acoustic transducers 80 that are identical in construction is disposed on the upper surface of the rear portion 70*r* of the frame 70 and the other of the two acoustic transducers 80 is disposed on the upper surface of the front portion 70*f* of the frame 70. The frame 70 basically has the same structure as that in existing known pianos except that the acoustic transducers 80 are disposed thereon. The position of each acoustic transducer 80 is determined to be a position selected from among positions at which the vibration of the frame 70 is caused or attained, such that the acoustic transducer 80 does not interfere with constructions such as the ribs 71, the openings, other components, and so on.

Figure 5A:
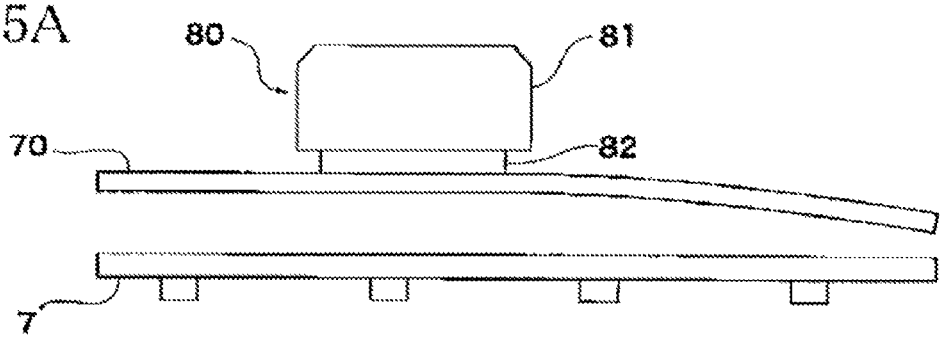
FIG. 5A is a schematic view showing a structure and a layout of one acoustic transducer and FIGS. 5B and 5C show modifications of the structure and the layout of the acoustic transducer.

FIG. 5A is a schematic view showing a structure and a layout of one acoustic transducer 80. The acoustic transducer 80 is an actuator of a voice-coil recoil type configured to vibrate a vibration target utilizing own inertia. The acoustic transducer 80 includes a weight (mass) portion 81 and an element portion 82 that is fixed to the upper surface of the plates portion of the frame 70. The element portion 82 is formed of a laminated piezoelectric element, a supermagnetostrictive element, or the like and is configured such that the element portion 82 infinitesimally contracts when a drive signal is input thereto, so that the frame 70 is vibrated by the inertia of the weight portion 81.

The type of the acoustic transducer 50 and the type of the acoustic transducer 80 may be vice versa, namely, the acoustic transducer 50 may be the voice-coil recoil type and the acoustic transducer 80 may be the voice-coil type. The acoustic transducer 50 and the acoustic transducer 80 may be the same type. Further, there may coexist different types in a plurality of acoustic transducers 50 or in a plurality of acoustic transducers 80. Moreover, the number of the acoustic transducers 50, 80 needs to be at least one, and the number of the acoustic transducers 50, 80 may be at least three.

Figure 5B:
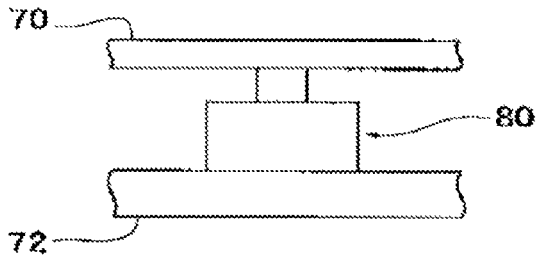
Figure 5C:
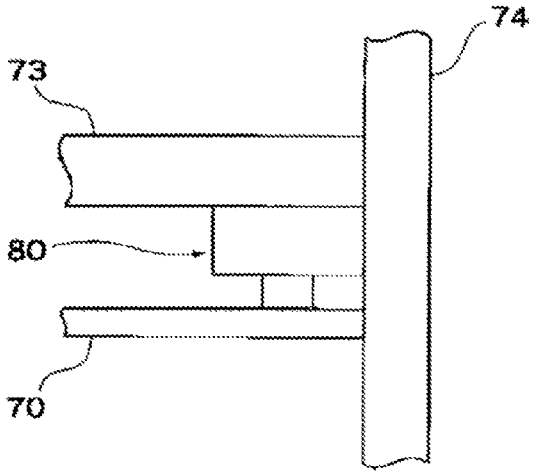

In an instance where there is employed, as the acoustic transducer 80, a recoilless (non-recoil) type like the acoustic transducer 50, the acoustic transducer 80 may be fixed to the support member 72, the side board 74, or the front rail 76. That is, as shown in FIG. 5B, the acoustic transducer 80 of the recoilless type may be attached to a portion of the support member 72 at which the support member 72 is opposed to the frame 70 with a spacing therebetween. Further, the acoustic transducer 80 may be attached to a support member 73 that is fixed to the side board 74, as shown in FIG. 5C. Moreover, while not illustrated, the acoustic transducer 80 may be attached to a support member that is fixed to the front rail 76. Thus, there is ensured a high degree of freedom in the attachment arrangement and the attachment position of the acoustic transducer 80 to the frame 70.

Figure 6:
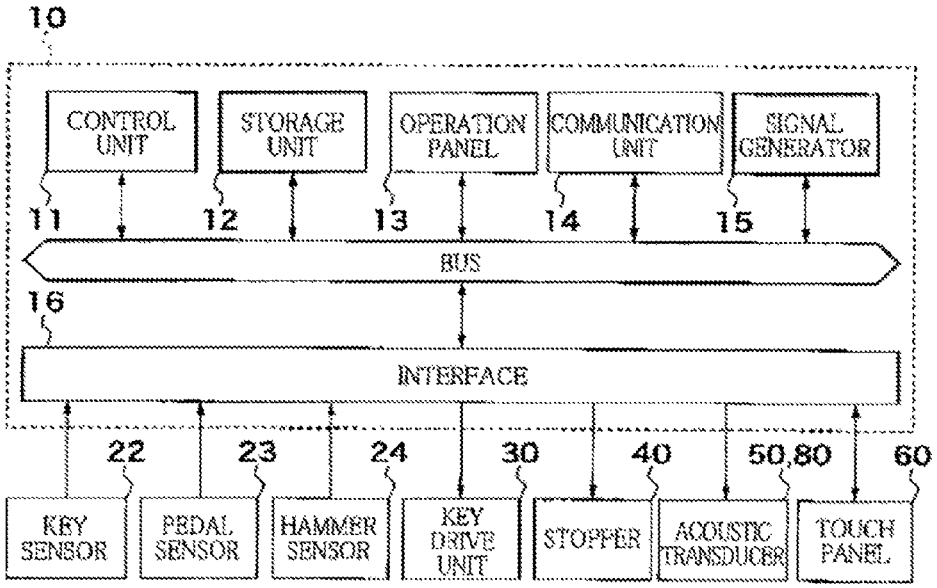
FIG. 6 is a block diagram showing a structure of a controller.

FIG. 6 is a block diagram showing a structure of the controller 10.

The controller 10 includes a control unit 11, a storage unit 12, the operation panel 16, a communication unit 14, a signal generator 15, and an interface 16 that are connected to one another via a bus.

The control unit 11 includes an arithmetic unit such as a CPU (Central Processing Unit) an a storage unit such as a ROM (Read Only Memory) and a RAM (Random Access Memory). The control unit 11 is configured to control various portions of the controller 10 and various components connected to the interface 16, on the basis of a control program stored in the storage unit.

The storage unit 12 stores setting information indicative of various settings to be used when the control program is being executed and the automatic performance data to be used in the automatic performance mode. The setting information is, for instance, information for determining details of a drive signal to be output from the signal generator 15, on the basis of performance information based on the detection signals that are output from the key sensor 22, the pedal sensor 23, and the hammer sensor 24 or on the basis of performance information included in the automatic performance data. The setting information includes information indicative of the sound generation mode and the performance mode set by the user.

The operation panel 13 includes operation buttons for receiving user's operations. When a user's operation is received through any of the operation buttons, an operation signal in accordance with the operation is output to the control unit 11. The touch panel 60 connected to the interface 16 has a display screen such as a liquid crystal display. On the display screen, there are displayed, under control of the control unit 11 via the interface 16, various sorts of information such as a setting change screen for changing details of the setting information stored in the storage unit 12, a setting screen for setting various modes, and a musical score. When a user's operation is received through a touch sensor, an operation signal in accordance with the operation is output to the control unit 11 via the interface 16. User's instructions to the controller 10 are input by user's operations received via the operation panel 13 and the touch panel 60.

The communication unit 14 is an interface for performing wireless or wired communication with other devices. Data to be input to the controller 10 via the communication unit 14 include, for instance, the automatic performance data, in MIDI format, of musical compositions or pieces to be used in automatic performance. Alternatively, the data may be performance data generated in real time by manual performance of external musical instruments.

Figure 7:
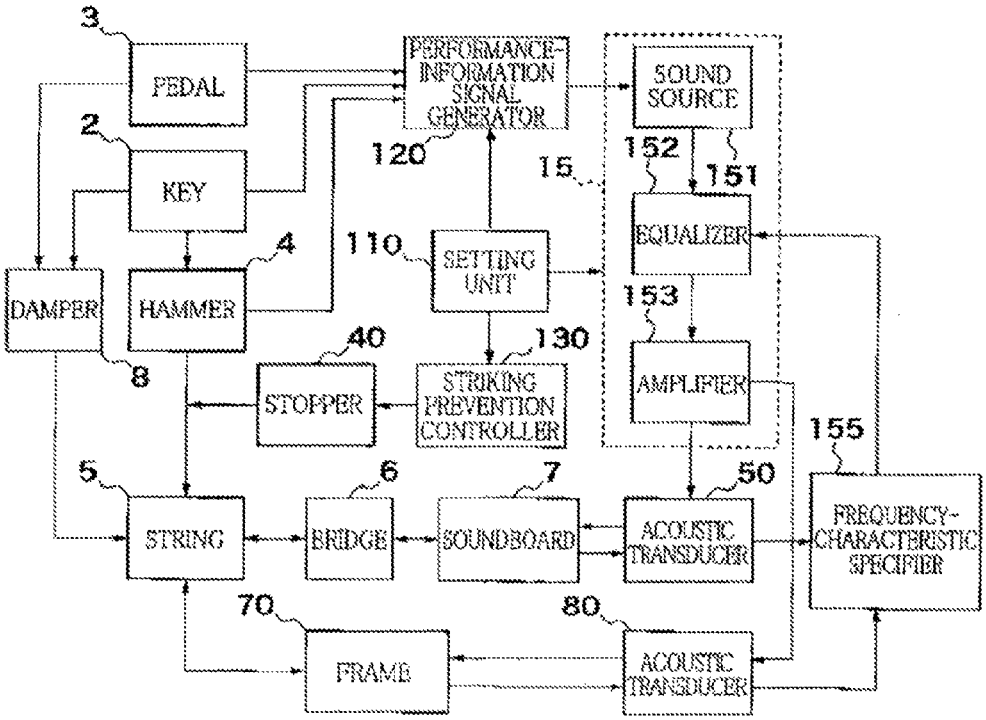
FIG. 7 is a block diagram showing a functional structure of the grand piano.

The signal generator 15 includes a sound source 151 for outputting acoustic signals, an equalizer 152 for adjusting frequency characteristics of each acoustic signal, and an amplifier 153 for amplifying the acoustic signal, as shown in FIG. 7. The signal generator 15 is configured to output, each as a drive signal, the acoustic signals whose frequency characteristics are adjusted and which are amplified.

The interface 16 is for connecting the controller 10 and various external components. The components connected to the interface 16 include the key sensor 22, the pedal sensor 23, the hammer sensor 24, the key drive unit 30, the stopper 40, the acoustic transducers 50, 80, and the touch panel 60. The interface 16 outputs, to the control unit 11, the detection signals that are output from the key sensor 22, the pedal sensor 23, and the hammer sensor 24 and the operation signal that is output from the touch panel 60. The interface 16 outputs, to the key drive unit 30, the control signal that is output from the control unit 11 and outputs, to the acoustic transducers 50, 80, drive signals that are output from the signal generator 15.

These will be next explained a configuration realized by execution of the control program by the control unit 11.

FIG. 7 is a block diagram showing a functional structure of the grand piano 1.

As shown in FIG. 7, when the key 2 is operated, the hammer 4 strikes the string 5 and the string 5 is vibrated. The vibration of the string 5 is transmitted to the frame 70 and to the soundboard 7 via the bridges 6. Further, the damper 8 is actuated by an operation of the key 2 or an operation of the pedal 3. By the action of the damper 8, a suppression state of the vibration of the string 5 changes.

A setting unit 110 is realized by the touch panel 60 and the control unit 11 as a configuration having the following function. The touch panel 60 receives a user's operation for setting the sound generation mode. The control unit 11 changes the setting information in accordance with the performance mode and the sound generation mode set by the user and, in accordance with these modes, outputs a control signal indicative of the selected sound generation mode to a performance-information signal generator 120 and a striking prevention controller 130.

Further, the touch panel 60 receives a user's operation for setting various control parameters in the signal generator 15. Various control parameters include parameters for determining a timing (tone color) of musical sounds represented by the acoustic signals output from the sound source 151, an amplification factor of the amplifier 153, and so on. An adjustment fashion of the frequency characteristics in the equalizer 152 is determined in advance.

The control unit 11 changes the setting information in accordance with the control parameters set by the user and controls the drive signals to be output from the signal generator 15 in accordance with the control parameters.

The performance-information signal generator 120 is realized by the control unit 11, the key sensor 22, the pedal sensor 23, the storage unit 12, the communication unit 14, the hammer sensor 24 and so on, as a configuration having the following function. Behaviors of the key 2, the pedal 3, and the hammer 4 are detected by the key sensor 22, the pedal sensor 23, and the hammer sensor 24. On the basis of the detection signals, the control unit 11 specifies striking timing of the string 5 by the hammer 4 (key-on timing), a number of the key 2 corresponding to the struck string 5 (key number), a striking velocity, and timing of suppression of the vibration of the string 5 by the damper 8 (key-off timing), as information to be utilized in the sound source 151 (i.e., performance information).

In the automatic performance mode, on the basis of the automatic performance data read out from the storage unit 12 or the automatic performance data input from the external via the communication unit 14, the control unit 11 specifies the key-on timing, the key number, the striking velocity, and the key-off timing, as information to be utilized in the sound source 151 (i.e., performance information).

In the present embodiment, the control unit 11 specifies the striking timing and the number of the key 2 from the behavior of the key 2, specifies the striking velocity from the behavior of the hammer 4, and specifies the vibration suppression timing from the behaviors of the key 2 and the pedal 3. In this respect, the striking timing may be specified from the behavior of the hammer 4, and the striking velocity may be specified from the behavior of the key 2. Here, the performance information may be information represented by a control parameter in the MIDI (Musical Instrument Digital Interface) format, for instance.

The control unit 11 outputs, to the sound source 151, the performance information indicative of the key number, the velocity, and the key on at the specified key-on timing. Further, the control unit 11 outputs, to the sound source 151, the performance information indicative of the key number and the key off at the specified key-off timing. The control unit 11 realizes the function described above when the sound generation mode set by the user is the weak sound mode or the strong sound mode while, in this example, the control unit 11 does not output the performance information to the sound source 151 when the sound generation mode set by the user is the normal sound generation mode. When the sound generation mode set by the user is the normal sound generation mode, it is required that any drive signal be not output from the signal generator 15. Accordingly, even if the performance information is arranged to be output, it is just required for the control unit 11 to control the signal generator 15 such that no drive signals are output therefrom.

The striking prevention controller 130 is realized by the control unit 11 as a configuration having the following function. When the sound generation mode set by the user is the weak sound mode, the control unit 11 controls the stopper 40 to move to a position at which striking of the string 5 by the hammer 4 is prevented. On the other hand, when the sound generation mode set by the user is the normal sound generation mode or the strong sound mode, the controller 11 controls the stopper 40 to move to a position at which striking of the string 5 by the hammer 4 is not prevented.

The sound source 151 generates each acoustic signal on the basis of the performance information output from the performance information signal generator 120 (the control unit 11). For instance, the sound source 151 generates the acoustic signal for providing a sound pitch corresponding to the key number and a sound volume corresponding to the velocity. In this example, the sound source 151 is configured to generate the acoustic signals in two systems, namely, an acoustic signal k1 for a drive signal k2 to be supplied to the acoustic transducer 50 for the soundboard 7 and an acoustic signal f1 for a drive signal f2 to be supplied to the acoustic transducer 80 for the frame 70.

The equalizer 152 adjusts frequency characteristics of each of the acoustic signal k1 and the acoustic signal f1 and outputs the adjusted signals. The adjustment fashion of the frequency characteristics for the acoustic signal k1 is specified by a frequency-characteristic specifier 155 in accordance with vibration characteristics of the soundboard 7 at the position at which each acoustic transducer 50 is attached to or held in closed contact with the soundboard 7. The adjustment fashion of the frequency characteristics for the acoustic signal f1 is specified by the frequency-characteristic specifier 155 in accordance with vibration characteristics of the frame 70 at the position at which each acoustic transducer 80 is attached to or held in close contact with the frame 70. Each of the acoustic signal k1, f1 whose frequency characteristics are adjusted by the equalizer 152 are amplified by the amplifier 153 and the amplified drive signals k2, f2 can be supplied to the acoustic transducers 50 and the acoustic transducers 80, respectively. In this respect, the drive signal k2 and the drive signal f2 are supplied to the acoustic transducers 50 and the acoustic transducers 80 simultaneously at key-on timing.

The acoustic signals k1, f1 in the two systems may be the same signal or may be mutually different signals. The drive signals k2, f2 may be the same signal or may be mutually different signals. Where the drive signals k2, f2 are the same signal, it is desirable that the drive signals k2, f2 be a signal having frequency characteristics corresponding to an entire sound range from the bass range to the treble range. The soundboard 7 does not generate sounds in an excessively high sound range whereas the frame 70 does not generates sounds in an excessively low sound range. Accordingly, even if the drive signals k2, f2 are the same signal corresponding to the same entire sound range, the timbre (tone color) and the sound range mainly responsible spontaneously become different between the soundboard 7 and the frame 70.

Where the frequency characteristics of the drive signal k2 and the frequency characteristics of the drive signal f2 are made different from each other, it is appropriate to make a frequency band of the drive signal f2 higher than a frequency band of the drive signal k2. In this instance, the acoustic signal f1 is subjected to processing for cutting off a lower frequency band executed by the equalizer 152, whereby the drive signal f2 is generated.

It is noted that the sound source 151 may generate a musical sound signal on the basis of the performance information and the musical sound signal may be converted to sounds at a speaker SP (FIG. 2) through an effect circuit (not shown). In other words, in the present embodiment, it is possible to suitably combine sound generation by the vibration of the string 5 (hereinafter referred to as "sound generation by string striking" where appropriate), sound generation by the vibration of the soundboard 7 by means of the acoustic transducers 50 (hereinafter referred to as "sound generation by soundboard vibration" where appropriate), sound generation by the vibration of the frame 70 by means of the acoustic transducers 80 (hereinafter referred to as "sound generation by frame vibration" where appropriate), and sound generation by the speaker SP (hereinafter referred to as "sound generation by speaker" where appropriate). For instance, the grand piano 1 may be configured to generate sounds by a combination of the sound generation by string striking and the sound generation by frame vibration or by a combination of the sound generation by string striking and the sound generation by the soundboard vibration. Further, the grand piano 1 may be configured to generate sounds by a combination of the sound generation by speaker and the sound generation by frame vibration. Moreover, the grand piano 1 may be configured to generate sounds by a combination of the sound generation by speaker, the sound generation by frame vibration, and the sound generation by soundboard vibration. Thus, where the sound generation by speaker is combined with the sound generation by frame vibration and/or the sound generation by soundboard vibration, the drive signal f2 and/or k2 are/is output from the signal generator 15 such that the frame 70 and/or the soundboard 7 are/is vibrated in synchronization with timing of the sound generation by speaker.

Further, it is possible, for instance, to allow the sound generation by speaker and the sound generation by frame vibration based on the automatic performance data without the sound generation by string striking. Moreover, it is possible to allow the sound generation by string striking and the sound generation by frame vibration by driving the key 2 and the acoustic transducers 80 based on the automatic performance data. With regard to automatic performance, in place of driving the key 2, a device for directly driving the hammer 4 may be provided, and the device may be driven based on the automatic performance data.

According to the present embodiment, the soundboard 7 and the frame 70 formed of the mutually different materials are vibrated respectively by the acoustic transducers 50 and the acoustic transducers 80, thereby making it possible to layer or superpose sounds of different timbres. Owing to the sound generation by frame vibration, in particular, it is possible to reproduce a metallic sound feel in the treble range peculiar to acoustic pianos. Accordingly, even in the absence of the sound generation by string striking, it is possible to emphasize, in a natural way, the treble range that would become insufficient by only the sound generation by soundboard vibration. In addition, because the frame 70 is located at a height level higher than a height level of the soundboard 7, the sense of sound image does not become too low, resulting in generation of natural and rich sounds. In this instance, when the sound generation by soundboard vibration and the sound generation by frame vibration are combined, different timbres can be layered even if the same drive signal is used in the sound generation by soundboard vibration and the sound generation by frame vibration, ensuring advantageous effects in terms of simplification of signal processing.

Where the sound generation by string striking is combined with the sound generation by frame vibration, the drive signal is generated based on the performance information in accordance with the operation of the key 2, and the frame 70 is vibrated by the acoustic transducers 80, whereby the treble range can be emphasized in a natural way when the sounds are generated in performance of the grand piano 1, ensuring generation of natural and rich sounds.

The acoustic transducers 50, 80 are mounted respectively on the soundboard 7 and the frame 70 that are existing components in ordinary pianos. Thus, the existing components can be utilized in sound layering.

The drive signals to be supplied to the acoustic transducers 50, 80 are not limited to those generated based on the performance information, but may be generated based on data obtained or stored in any suitable way.

From the viewpoint of layering different timbres by the vibration of the soundboard 7 and the vibration of the frame 70, the material, the thickness, and the shape of the soundboard 7 and the frame 70 may be considered in conjunction with one another, and the natural frequency of the soundboard 7 and the natural frequency of the frame 70 may be made different from each other by combinations of those factors. The target components to be vibrated by the acoustic transducers 50, 80 are not limited to components called a soundboard and a frame, as long as the components have respective plate portions that are opposed to each other when one of the components is overlaid on the other.

<Second Embodiment>

Figure 8:
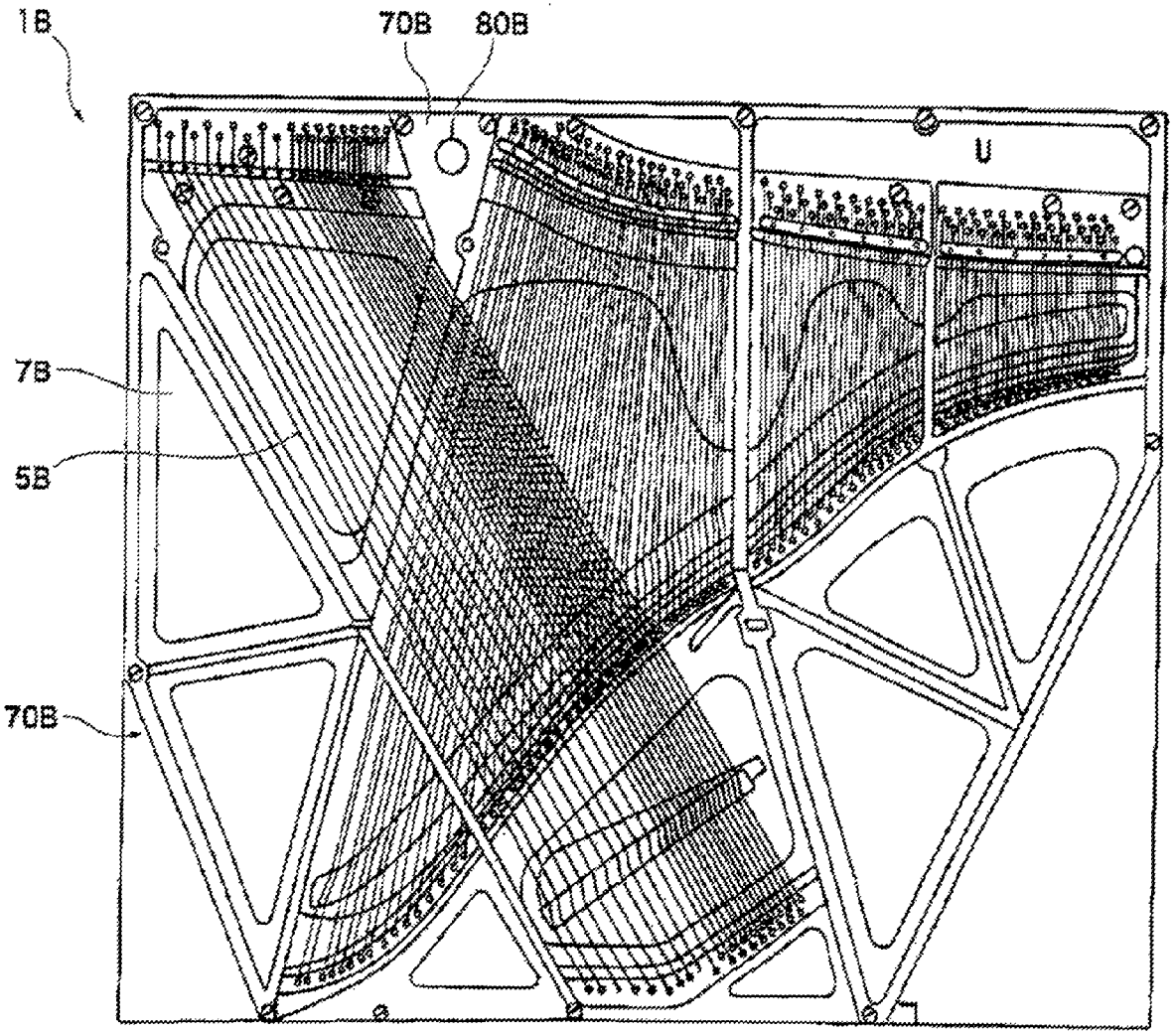
FIG. 8 is a front view showing frame groups in a keyboard musical instrument according to a second embodiment of the invention.
Figure 9:
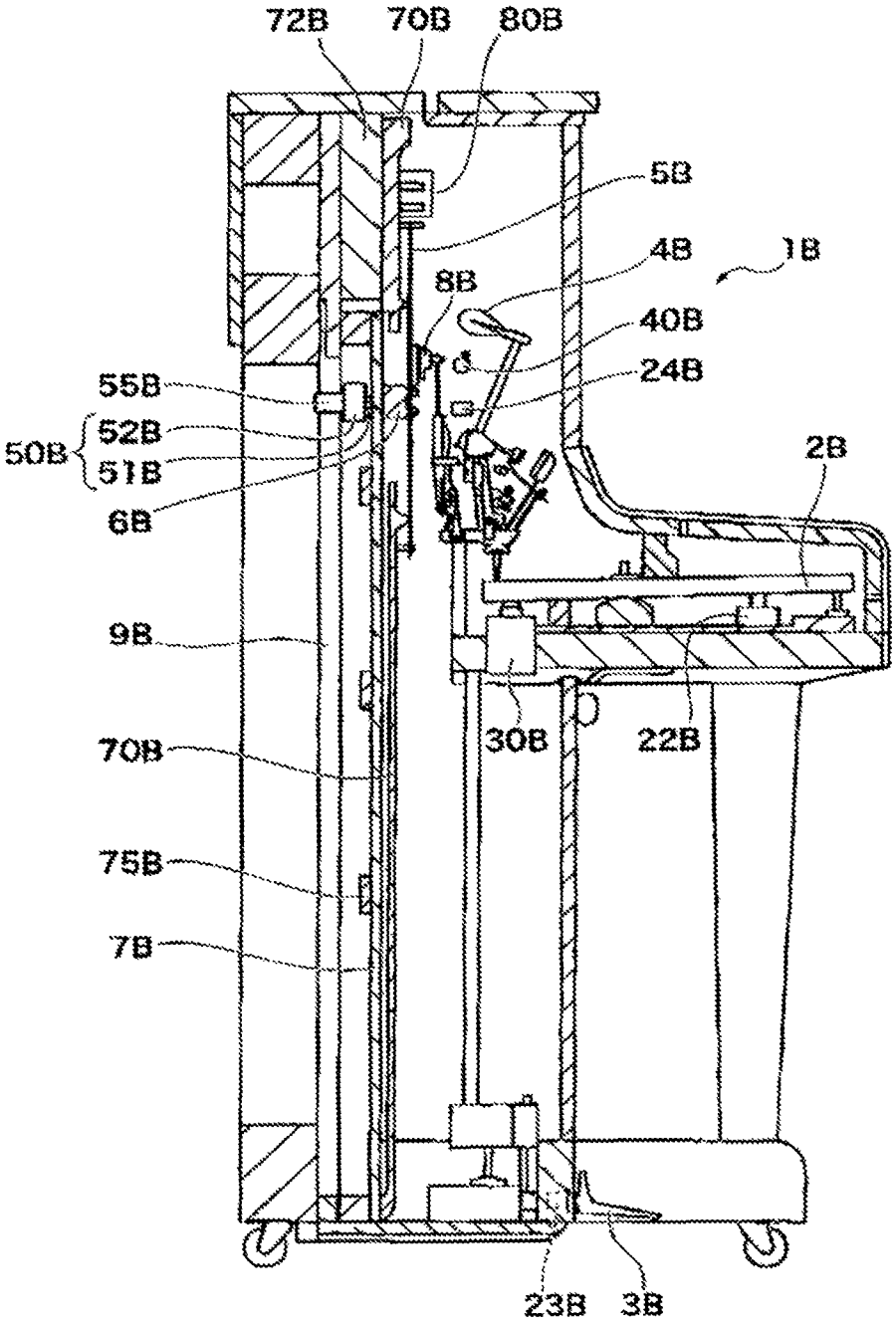
FIG. 9 is a cross sectional view showing an internal structure of the keyboard magical instrument.

FIG. 8 is a front view showing frame groups in a keyboard musical instrument according to a second embodiment of the invention. FIG. 9 is a cross-sectional view showing an internal structure of the keyboard musical instrument.

In the second embodiment, an upright piano 1B is illustrated as one example of the keyboard musical instrument. In FIGS. 8 and 9, components in the upright piano 1B are indicated by the same reference numerals, but together with "B", as used in the first embodiment to identify the corresponding components in the grand piano 1 of the first embodiment.

In the upright piano 1B, an acoustic transducer 50B is connected or held in close contact with a soundboard 7B, and an acoustic transducer 80B is connected to or held in close contact with a frame 70B. As shown in FIG. 8, the acoustic transducer 50B is disposed at a position of one surface of the soundboard 7B at which the acoustic transducer 50B is opposed to a bridge 6B with the soundboard 7B interposed therebetween. The acoustic transducer 50B is held in close contact with the soundboard 7B such that the acoustic transducer 50B is supported by a support portion 55B that is fixed to a back post 9B. The acoustic transducer 50 has a vibration portion 51B that is held in close contact with the soundboard 7B and a yoke holding portion 52B supported by the support portion 55B. The acoustic transducer 80B is disposed on a front surface of an upper portion of the frame 70B, for instance.

As in the illustrated first embodiment, the position of the acoustic transducer 80B is determined to be a position selected from among positions at which the vibration of the frame 70B is caused or attained, such that the acoustic transducer 80B does not interfere with constructions, openings, other components, and so on. At least two acoustic transducers 80B may be provided. As in the illustrated first embodiment, the type of each of the acoustic transducers 50B, 80B may be any of the voice-coil type and the voice-coil recoil type.

In an instance where there is employed the recoilless (non-recoil) type as the acoustic transducer 80B, the acoustic transducer 80B may be fixed to a top board, a bottom board, or a front board, other than a support member 72B.

The second embodiment ensures advantages similar to those in the illustrated first embodiment, in terms of generation of natural and rich sounds.

In the grand piano 1, the weak sound mode may not be necessarily provided. In a musical instrument without the weak sound mode, the frame 70 may be configured to be vibrated in sound generation by string striking.

It is to be understood that the present invention is applicable to not only pianos but also keyboard percussion musical instruments such as Celesta and Glockenspiel. In this instance, the frame may be configured to support, in place of strings, sound generators such as sound bars and sound sticks each of which is configured to vibrate by being struck and to vibrate other members by vibration thereof or in association with vibration thereof, for sound generation.

It is further noted that the present invention is applicable to musical instruments without having the soundboard. In this instance, by vibrating the frame that supports the sound generators, the sound generators are vibrated via the frame. As a result, natural and rich sounds can be generated. Further, even in musical instruments having the soundboard, the frame is vibrated by the acoustic transducer instead of vibrating the soundboard by the acoustic transducer, whereby natural and rich sounds can be generated.

What is claimed is:

1. A keyboard musical instrument, comprising:

a key;

a sound generator configured to generate sound in response to an operation of the key;

a board;

a first member formed of a material different from a material of the board;

a first acoustic transducer configured to vibrate the board in accordance with a drive signal to the first acoustic transducer supplied thereto; and a second acoustic transducer configured to vibrate the first member in accordance with a drive signal to the second acoustic transducer supplied thereto, wherein the board is a soundboard further configured to be vibrated by vibration of the sound generator.

2. The keyboard musical instrument according to claim 1, further comprising: a hammer configured to strike the sound generator in response to the operation of the key, wherein the first member is a frame that supports the sound generator.

3. The keyboard musical instrument according to claim 1, wherein the board is formed of wood, and the first member is formed of metal.

4. The keyboard musical instrument according to claim 1, further comprising a signal generator configured to generate a generated drive signal based on at least one of performance information generated in accordance with the operation of the key, performance information read out from a storage unit, and performance information sent from an external device, and configured to supply the generated drive signal as at least one of the drive signal to the first acoustic transducer and the drive signal to the second acoustic transducer.

5. The keyboard musical instrument according to claim 4, wherein the signal generator is configured to supply the generated drive signal simultaneously as the drive signal to the first acoustic transducer and the drive signal to the second acoustic transducer when supplying the generated drive signal to both of the first acoustic transducer and the second acoustic transducer.

6. The keyboard musical instrument according to claim 4, further comprising: a hammer configured to strike the sound generator in response to the operation of the key; and a detector configured to detect the operation of the key, wherein the signal generator is configured to supply the drive signal to the second acoustic transducer based on the operation of the key detected by the detector, such that the first member is vibrated in synchronization with timing when the hammer strikes the sound generator.

7. The keyboard musical instrument according to claim 4, further comprising a speaker configured to emit sound based on a sound signal supplied thereto, wherein the signal generator is configured to supply the drive signal to the second acoustic transducer such that the first member is vibrated in synchronization with timing when the speaker emits the sound.

8. The keyboard musical instrument according to claim 4, wherein the signal generator is configured to generate the drive signals to be supplied to the first acoustic transducer and the second acoustic transducer, respectively, such that a frequency band of the drive signal to the second acoustic transducer is larger than a frequency band of the drive signal to the first acoustic transducer.

* * * * *